United States Patent [19]

Arita et al.

[11] Patent Number: 5,042,957

[45] Date of Patent: Aug. 27, 1991

[54] MOVING TYPE THREE-DIMENSIONAL ROAD

[75] Inventors: Masahiro Arita; Akihiko Minaki, both of Kobe, Japan

[73] Assignee: Mitsubishi Jukogyo Kabushiki Kaisha, Tokyo, Japan

[21] Appl. No.: 451,744

[22] Filed: Dec. 18, 1989

[30] Foreign Application Priority Data

Jan. 27, 1989 [JP] Japan ..... 1-7648

[51] Int. Cl.[5] ..... E01C 7/00

[52] U.S. Cl. ..... 404/71; 404/1; 14/1

[58] Field of Search ..... 14/1; 404/1, 71

[56] References Cited

U.S. PATENT DOCUMENTS

| | | | |
|---|---|---|---|
| 648,620 | 5/1900 | Holmes | 14/72.5 |
| 1,924,779 | 8/1933 | Flynn | 404/1 |
| 2,363,767 | 11/1944 | Yassin | 14/1 |
| 3,301,146 | 1/1967 | Krug et al. | 404/1 |
| 3,365,895 | 1/1968 | Jacobs | 404/1 |
| 3,411,167 | 11/1968 | Sedlacek | 404/1 |
| 3,810,706 | 5/1974 | Grimm et al. | 404/1 |
| 3,811,147 | 5/1974 | Dix | 14/1 |
| 4,144,979 | 3/1979 | Leach, Jr. et al. | 14/71.1 |
| 4,235,399 | 11/1980 | Shorey | 14/71.1 |
| 4,242,032 | 12/1980 | Whiteman et al. | 14/71.1 |
| 4,348,780 | 9/1982 | Angelo et al. | 14/1 |
| 4,698,866 | 10/1987 | Kano | 14/1 |

FOREIGN PATENT DOCUMENTS

| | | | |
|---|---|---|---|
| 1212112 | 11/1970 | United Kingdom | 404/71 |

*Primary Examiner*—Ramon S. Britts
*Assistant Examiner*—Gay Ann Spahn
*Attorney, Agent, or Firm*—Wenderoth, Lind & Ponack

[57] ABSTRACT

A moving type three-dimensional road which can travel to a region where road surface repair work is to be carried out, includes a working road constituent unit associated with a traveling device and a plurality of access road constituent units associated with traveling devices. The working road constituent unit includes a horizontal floor plate disposed above and supported by a plurality of extensible/retractible support legs to form a working space thereunder. The access road constituent units are connected to the opposite ends of the working road constituent unit, and each includes an inclined floor plate disposed above and supported by a plurality of extensible/retractible support legs.

4 Claims, 15 Drawing Sheets

X
Y
4
7
8
35
36

MOVING TYPE THREE-DIMENSIONAL ROAD

BACKGROUND OF THE INVENTION

1. Field of the Invention:

The present invention relates to a moving type three-dimensional road that is useful as a temporary overhead road during road surface repair work, and further that is useful as a replacement for a girder of a bridge or an overhead road.

2. Description of the Prior Art:

Heretofore, during road repair or the like, it was a common practice to block the repair region and process traffic through a detour and restricted lanes.

In addition, a moving type three-dimensional road was employed. As one example of the prior art with reference to FIG. 31, an emergency bridge 01 is provided with three connected pony truss type main trusses 02. The bottom of the effective span of each main truss 02 is supported by supports 03. Each main truss 02 is divided into a plurality of spans, and the respective span main trusses 02*a*, 02*b* and 02*c* are integrated by pin-connections.

The respective supports 03 are provided with fixing means for obtaining a support reaction force by jack operations and a traveling mechanism of a caster type using tires, and can travel onto a predetermined road surface to be repaired.

Through the provision of a detour and the restriction of lanes which were effected in the prior art during road surface repair at a general road or at an overhead road, it has become hard to prevent traffic jams due to the increase in traffic in recent years and the difficulty in providing effective detours in towns and cities.

The aforementioned moving type three-dimensional road in the prior art is an enormous structure and is heavy. Since a crane is necessary to assemble the road at the working location, it take a long time to assemble the road to and at the repair spot of the road. Accordingly, the aforementioned moving type three-dimensional road in the prior art involved the problem that the time for repairing a road cannot be reduced much, and since the weight is great, the positions for supporting the moving type three-dimensional road were limited to the proximities of expansion joints on a girder of an existing overhead bridge, and so, repair of the expansion joints became impossible.

SUMMARY OF THE INVENTION

The present invention has been developed to resolve the aforementioned technical problems, and it is one object of the present invention to provide a moving type three-dimensional road in which the ease in which the road may be carried, may travel and may be installed to and at a bridge or a road surface is enhances, a performance of a three-dimensional road as a temporary installation is improved, and the ease in which work can be performed under the same three-dimensional road is enhanced.

According to one feature of the present invention, there is provided a moving type three-dimensional road for forming an arched three-dimensional surface, comprising a working road constituent unit associated with a traveling device, which unit includes a horizontal floor plate supported by a plurality of extensible/retractible support legs to form a working space thereunder, and a plurality of access road constituent units associated with traveling devices, which units are detachably connected to the opposite ends of the working road constituent unit, and each of which units includes an inclined floor plate supported by a plurality of extensible/retractible support legs.

According to another feature of the present invention, there is provided the above-featured moving type three-dimensional road, wherein each of the working road constituent unit and the access road constituent units includes a central structure serving as a running passageway and side structures on the respective sides of the central structure, and the side structures are connected to the central structure so as to be movable sidewards.

According to still another feature of the present invention there is provided the last-featured moving type three-dimensional road, wherein the extensible/retractible support legs are provided in the side structures.

According to yet another feature of the present invention, there is provided the first-featured moving type three-dimensional road, wherein between the working road constituent unit and the access road constituent unit or between adjacent ones of the access road constituent units there is provided a connecting device consisting of a male metal member provided at one end of one of the units in a protrusible/retractible manner, and a female metal member provided at an end portion of the other units in a protrusible/retractible manner and adapted to pinch and engage the male metal member.

According to a further feature of the present invention, there is provided the last-featured moving type three-dimensional road, wherein the connecting device is rotatable about a vertical axis with respect to either one of the units to be connected.

According to a still further feature of the present invention, there is provided the first-featured moving type three-dimensional road, wherein a traveling device having a steering wheel is provided in each of the working road constituent unit and the access road constituent units.

According to the present invention, owing to the aforementioned structural features, separation of the working road constituent unit and the access road constituent units into individual units as well as extension and retraction of the extensible/retractible support legs facilitate transportation of the three-dimensional road, and by the connection and traveling of the respective road constituent units and by the extension and retraction of the support legs, the traveling and installation of the three-dimensional road are facilitated to temporarily form athree-dimensional road surface under which a working space is surely provided.

In using the moving type three-dimensional road according to the present invention, the working road constituent unit and the plurality of access road constituent units are first separated from one another. Then, by extending or retracting the extensible/retractible support legs the respective units can be easily loaded on a trailer or the like and conveyed thereby. Thereafter, the aforementioned respective units are connected and travel as driven by a traveling device to a desired location such as a bridge, a road surface or the like. By extending or retracting the extensible/retractible support legs, the floor plate is adjusted to and settles at a desired height. Thus an arched three-dimensional road surface can be easily provided temporarily to make the passage of traffic through the location possible. On the other hand, a desired working space can be formed under floor plates of the central portion of the working road constituent unit, whereby jobs such as repair work can be executed smoothly.

The above-mentioned and other objects, features and advantages of the present invention will become more apparent by referring to the following description of one preferred embodiment of the present invention taken in conjunction with the accompanying drawings.

DETAILED DESCRIPTION OF THE PREFERRED EMBODIMENT

Figure 1A:
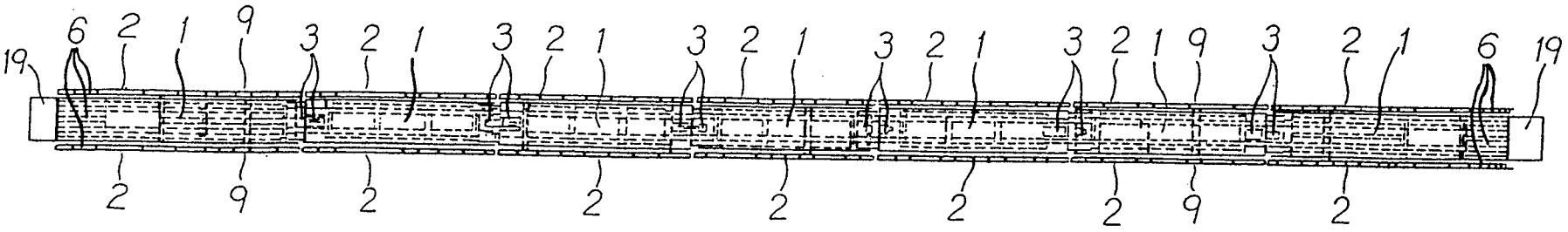
FIGS. 1(A) and 1(B) are a plan view and a front view, respectively, of one preferred embodiment of a three-dimensional road according to the present invention.
Figure 1B:
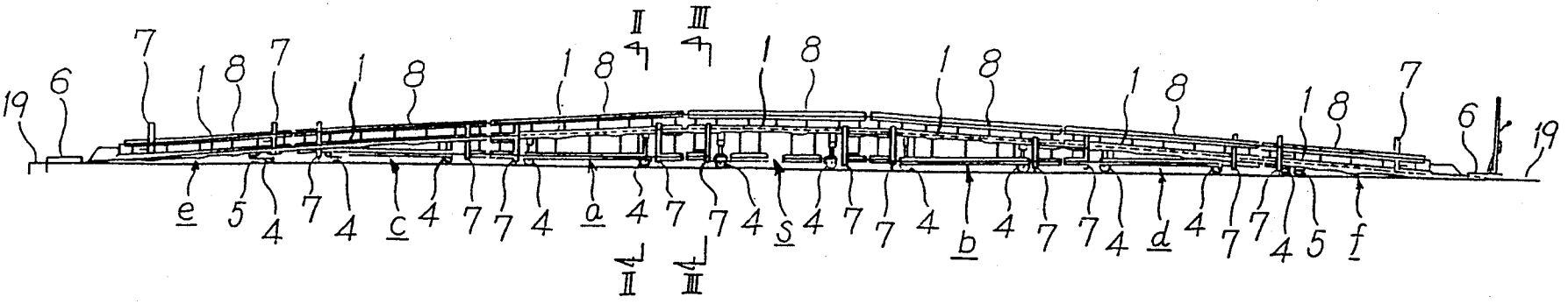

One preferred embodiment of the present invention is illustrated in FIGS. 1 through 30. In FIGS. 1(A) and 1(B), reference character S designates a working road constituent unit (working module), and reference characters a, b, c, d, e and f designate access road constituent units (access modules) adapted to be detachably connected to the respective ends of the working road constituent unit S.

In these figures, reference numeral 1 designates floor plates, numeral 2 designates main girders (width expanding sections), numeral 3 designates connecting devices, numeral 4 designates traveling devices, numeral 5 designates moving type traveling devices, numeral 6 designates end approach sections, numeral 7 designates extensible/retractible support legs, numeral 8 designates hand rails, numeral 9 designates width expanding devices, and numeral 19 designates end rubber members. These component members jointly constitute an arched three-dimensional road that can travel by itself as shown in FIG. 1(B). At the top of the three-dimensional road is disposed a horizontal floor plate 1 to form a working space thereunder, and on the opposite ends of the horizontal floor plate 1 are connected inclined floor plates 1.

Figure 2:
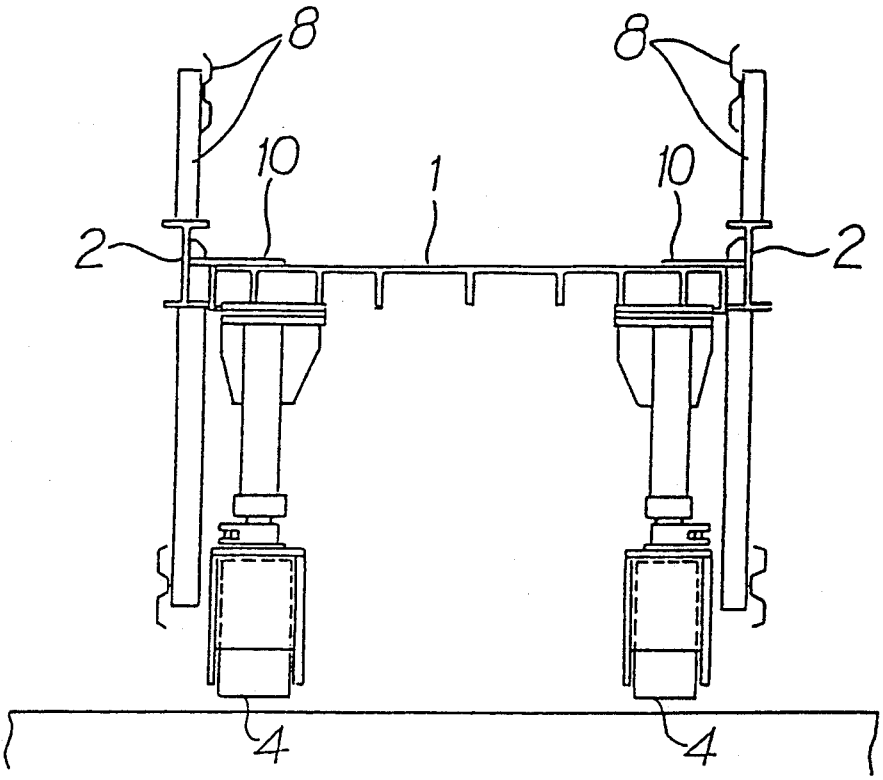
FIG. 2 is a vertical cross-sectional view taken along line II—II in FIG. 1(B)
Figure 3:
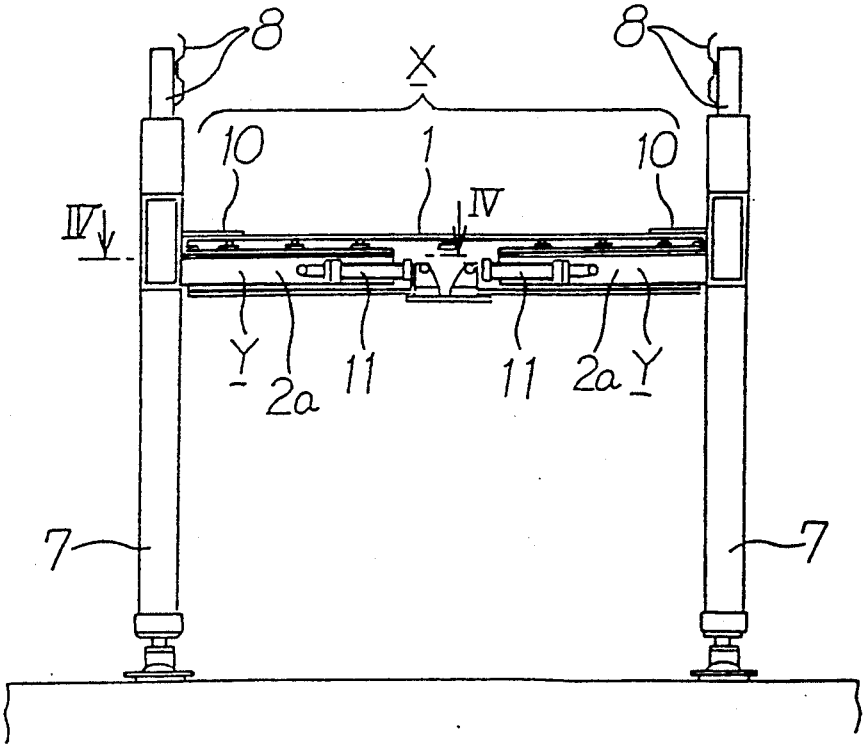
FIG. 3 is a horizontal cross-sectional view taken along line III—III ,in FIG. 1(B)

As shown in FIGS. 2 and 3, each of the working road constituent unit S and the access road constituent units a–f consists of a central structure X serving as a running passageway and side structures on the respective sides of the central structure X. The central structure X is provided with a horizontal or inclined floor plate 1 made of steel and serving as a road surface, and is equipped with respective traveling devices 4 at four locations at the opposite ends and which devices 4 extend from the lower surface of floor plate 1. Each of the side structures Y consists of a main girder 2, an extensible/retractible member 2*a* slidably inserted into the corresponding side of the central structure X, a hand rail 8 on an upper part thereof, a width expanding floor plate 10, a plurality of extensible/retractible support legs 7 on a lower part thereof, and the like, which together constitute a width expanding mechanism.

Figure 4:
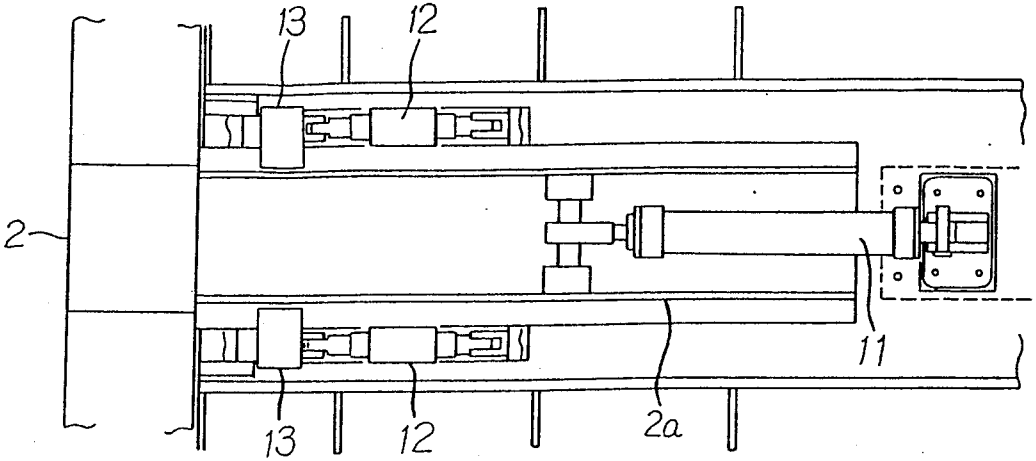
FIG. 4 is a partial cross-sectional view taken along line IV—IV in FIG. 3.
Figure 5:
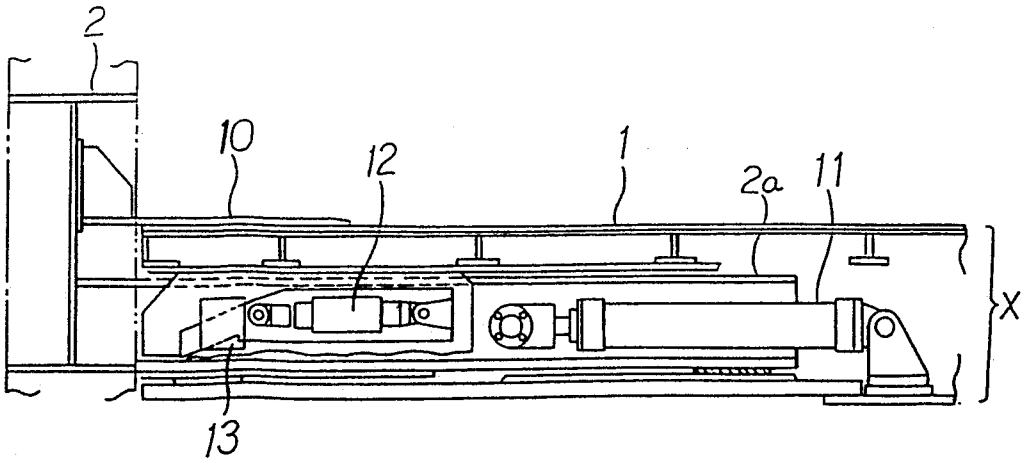
FIG. 5 is a side view of the structure shown in FIG. 4.

The above-mentioned width expanding mechanism has the structure shown in FIGS. 4 and 5 in which a rod end side of a width expanding cylinder 11 pivotably secured to the bottom of the floor plate 1 in the central structure X is connected to the above-mentioned extensible/retractible member 2*a*. Hence, by the extension and retraction of this cylinder 11, the side structure Y is made to slide in the transverse direction of the road, that is, sidewards. And, upon the sliding of the side structure Y, the expanding floor plate 10 moves in the width expanding direction as held in contact with the upper surface of the corresponding side portion of the floor plate 1 to serve as a floor plate of the corresponding side of the running passageway. In addition, in order to fix the side structure Y, upon the expansion or contraction of the width, to the central structure X, a fixing mechanism is provided in which a main girder fixing cylinder 12 is mounted to the central structure X and a wedge 13 is pushed via a rod of the cylinder 12.

Upon movement and traveling, the respective units are supported by the traveling devices 4 provided at the lower portion of the central structure X, while upon installation of the three-dimensional road, the extensible/retractible support legs 7 provided at the lower portion of the side structures Y are extended and the load of the side structures Y and the central structure X is supported by these support legs 7.

Figure 6:
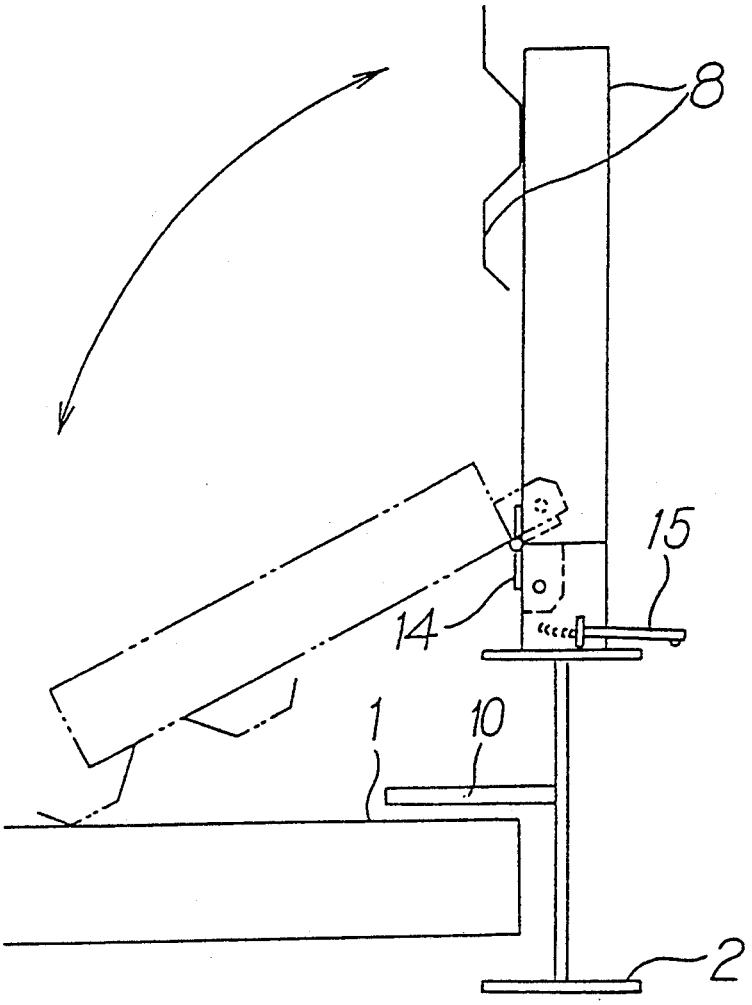
FIG. 6 is a side view of a tilt-and-fall type hand rail of the present invention.

Although movement of the working and access road constituent units S and a–f can be carried out by loading vehicles such as trailers, the aforementioned constituent units S and a–f may exceed the limit on height provided by the Road Traffic Control Law. Therefore, titling and felling the hand rail 8 at the top of the side structure Y can be facilitated by means of a hinge 14 and a pin 15 as shown in FIG. 6.

Figure 7:
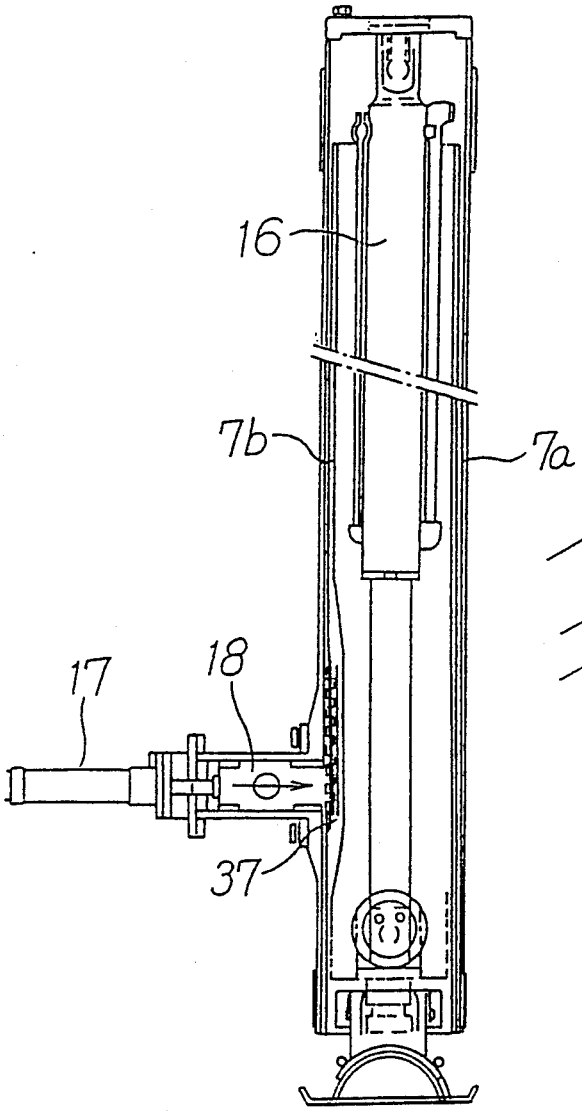
FIG. 7 is a vertical cross-sectional view of an extensible/retractible support leg of the present invention.
Figure 8:
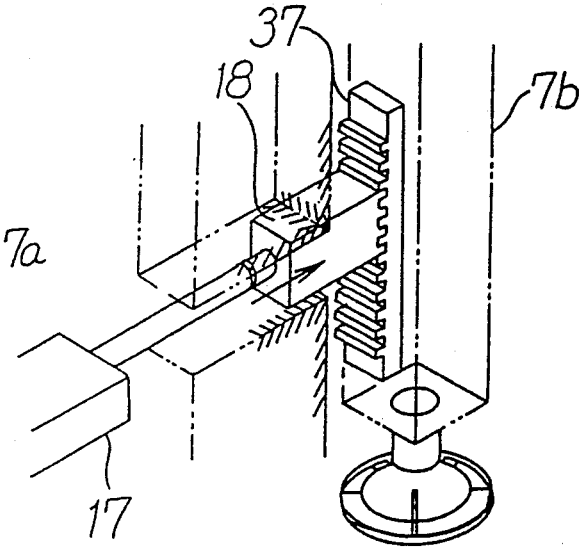
FIG. 8 is a perspective view of a fixing mechanism portion in FIG. 7.

As shown in FIGS. 7 and 8, the extensible/retractible support leg 7 comprises an outer tube *7a* fixed in the side structure Y, an inner tube *7b* disposed within the outer tube *7a* so as to be vertically extensible and retractible by means of a hydraulic cylinder 16, and a grounding metal member at the bottom. To the outer tube *7a* is mounted an extension/retraction fixing metal member 18 via a hydraulic cylinder 17 to fix the leg upon the extension thereof by causing the extension/retraction fixing metal member 18 to engage a support leg positioning plate 37 provided on the side of the inner tube *7b*.

As shown in FIGS. 9 to 12, in the end access road constituent units e and f on the road surface to be repaired, a folding device 21 for folding an end approach floor plate 20 onto the inclined floor plate 1 on the side of the main body as well as a fixing device 24 are provided on the end of the main girder 2 of the side structure Y. While the end approach floor plate 20 is kept folded, the width expanding operations may be carried out on the main body as shown in FIG. 11(B). Reference numeral 19 in FIG. 9 designates end rubber members.

While it is necessary that the end approach portion have an adjustable width similar to the main body, since it is impossible to accommodate a width expanding mechanism (a driving device for expanding a width) in the end approach floor plate 20, the end approach floor plate 20 is provided with only a guide to be used upon the adjustment of the width of end approach side portion floor plates 23.

Figure 11B:
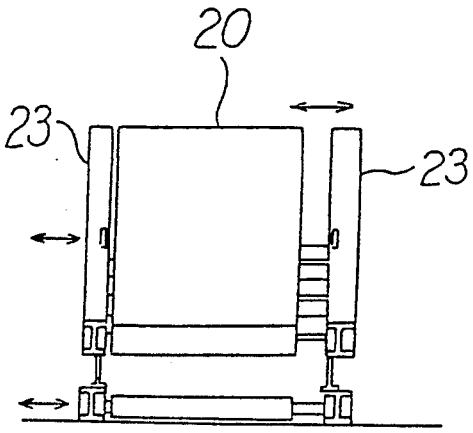
FIG. 11(B) is a side view of the structure shown in FIG. 11(A)
Figure 11A:
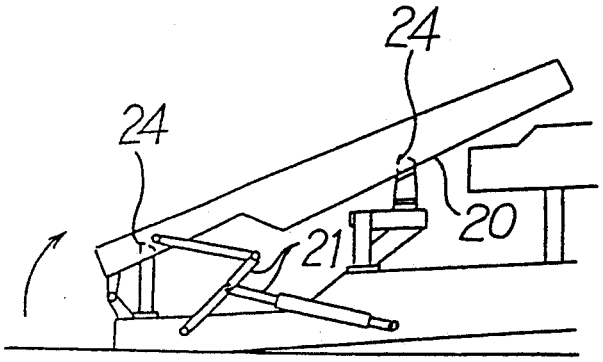
FIG. 11(A) is a front view of an end approach section of the three-dimensional road in a raised condition.
Figure 12:
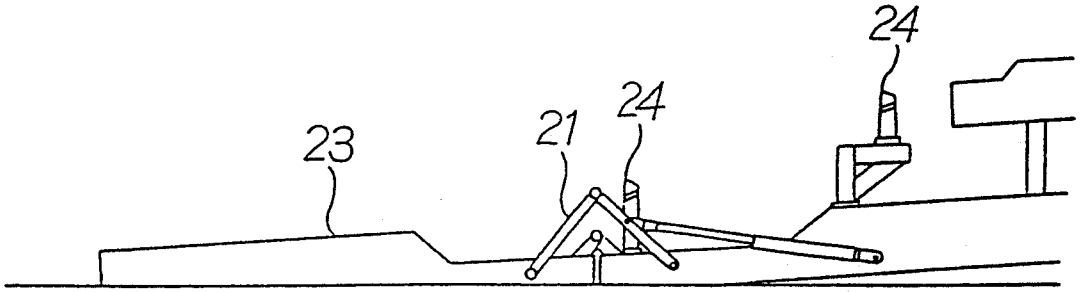
FIG. 12 is a front view of the end approach section in an extended state.
Figure 13:
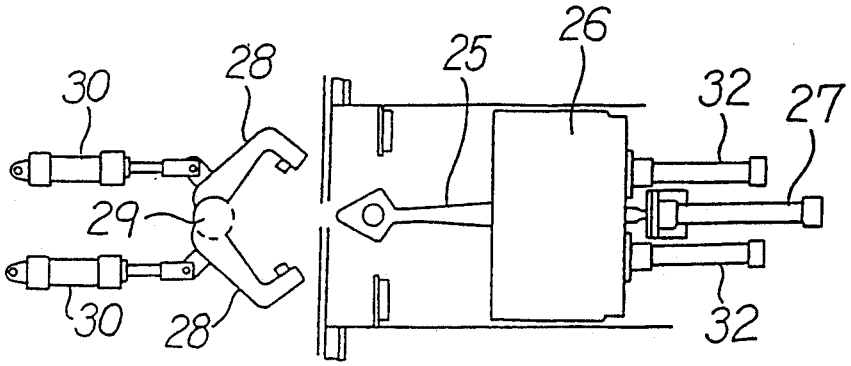
FIGS. 13 to 16 are plan views of a connecting device showing the successive steps in a connecting process carried out by the connecting device.
Figure 14:
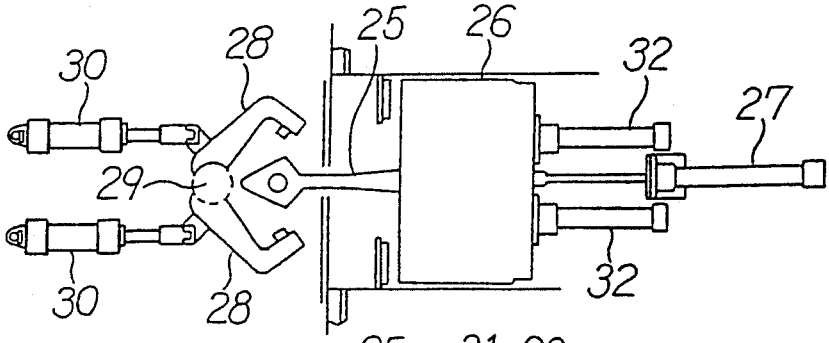
Figure 15:
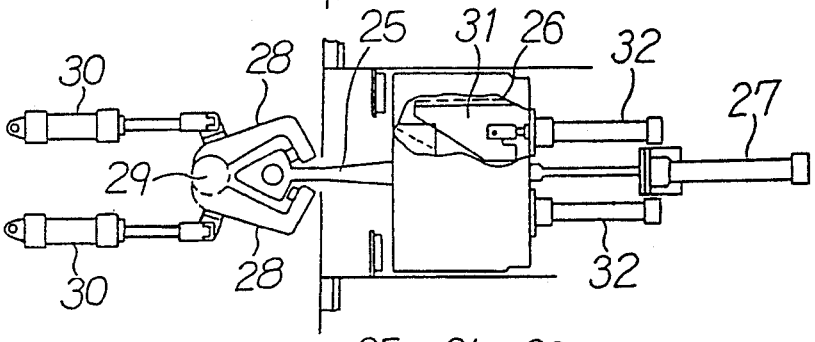
Figure 16:
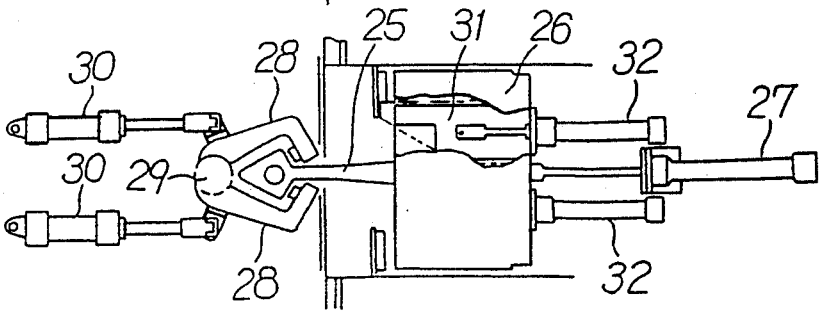

During the width expanding operation, the end approach portion is folded to the side of the main body (FIG. 11). Since the end approach side portion floor plates 23 and the main body width expanding portions (main girders 2) are integrated by means of fixing devices 24 projecting from the width expanding portion of the main body, when the main body width expanding portion is expanded by the width expanding device on the main body, the end approach side portion floor plate 23 is expanded by the same device.

Figure 9:
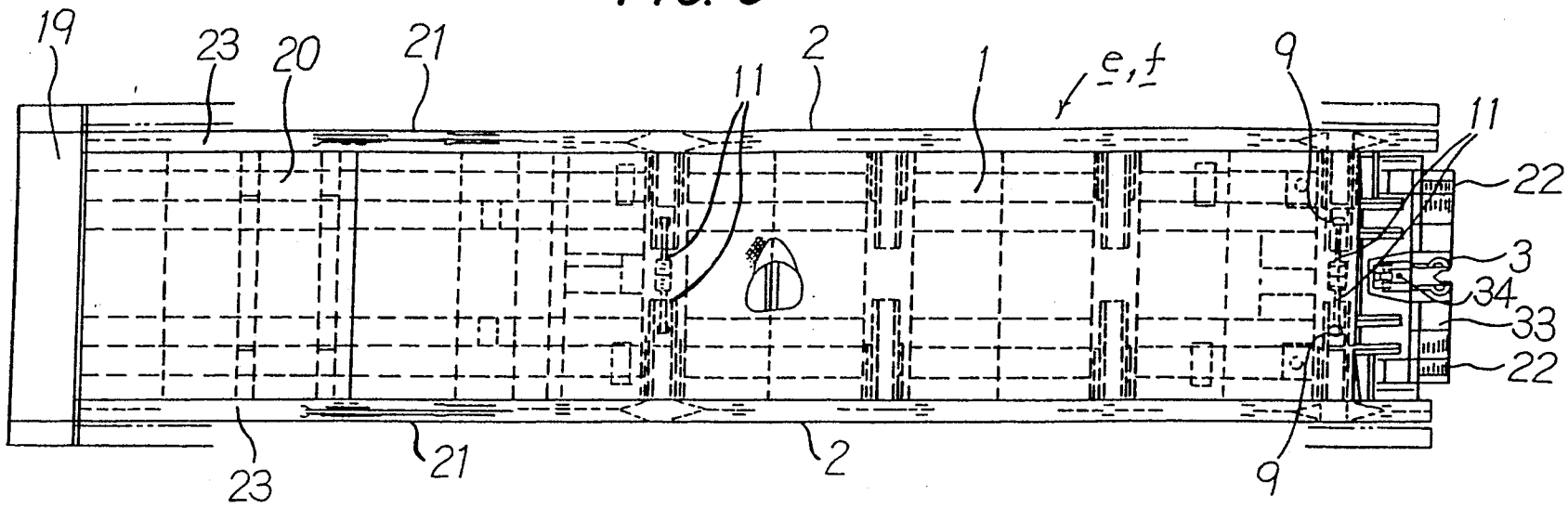
FIG. 9 is a plan view of an access road constituent unit at an end portion of the three-dimensional road.
Figure 10:
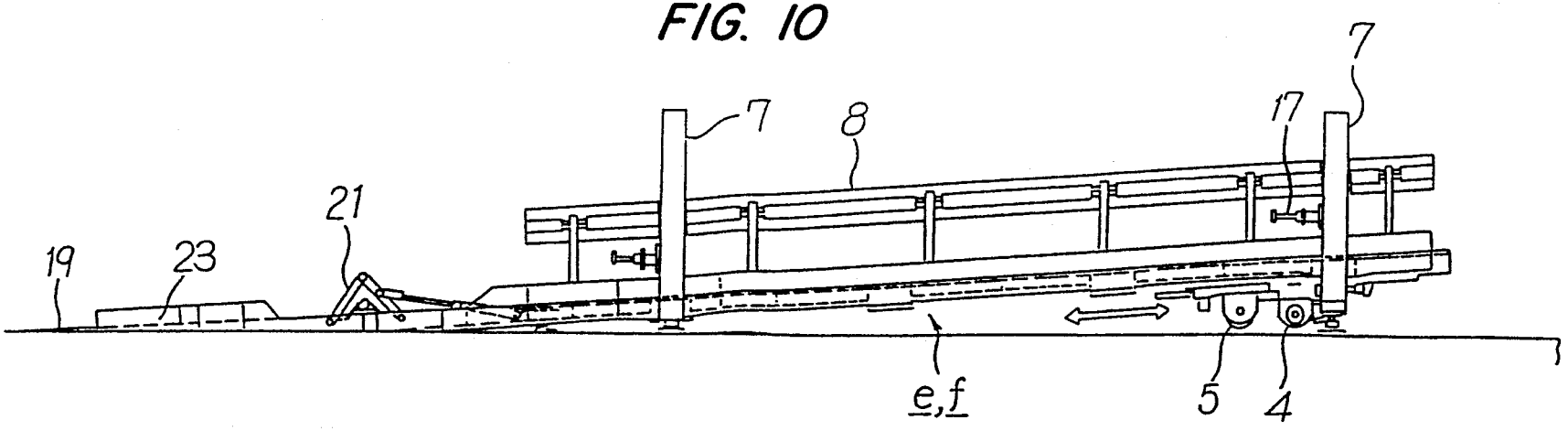
FIG. 10 is a side view of the structure shown in FIG. 9.

In addition, as shown in FIGS. 9 and 10, movable type traveling devices 5 of the access road constituent units e and f are movable along the main girders 2, in the directions of the arrows in FIG. 10, by chain drive or the like. When the above-mentioned units e and f are to be installed with their weight supported by the extensible/retractible support legs 7, the traveling devices 5 are moved towards the traveling devices 4 to thereby settle the running passage surface at a predetermined inclination. On the other hand, when the units e and f are to be moved (upon self-traveling over a short distance to a location at which a repair is to be carried out), the movable type traveling devices 5 support the weight of the above-mentioned units at predetermined positions adjacent the end approach section.

Next, as shown in FIGS. 13 to 16, the connecting device between the aforementioned respective road constituent units includes a male metal member 25 at an end portion of either one of the adjacent units S and a–f to be connected. Member 25 can be projected in the traveling direction of the three-dimensional road beyond the end portion of the above-mentioned unit by means of a hydraulic cylinder 27. At the opposed end portion of the adjacent unit is a female metal member 28 which can pinch the tip end portion of the male metal member 25 by being driven by a hydraulic cylinder 30. Thus, the respective units are connected. In these figures, reference numeral 26 designates a movable block to which the male metal member 25 is mounted, numeral 29 designates a pin, and numeral 32 designates a hydraulic cylinder mounted to the movable block 26.

The connecting portion between the adjacent road constituent units must transmit force in the lateral direction between the adjacent units when such a force is generated after connection, in addition to the function of connecting the adjacent units. At the same time, a deviation between the center lines of the respective units (a deviation between the neutral lines of the male metal member 25 and the female metal member 28) is absorbed to a certain extent at the connecting portion.

Figures 17A, 17B, 17C:
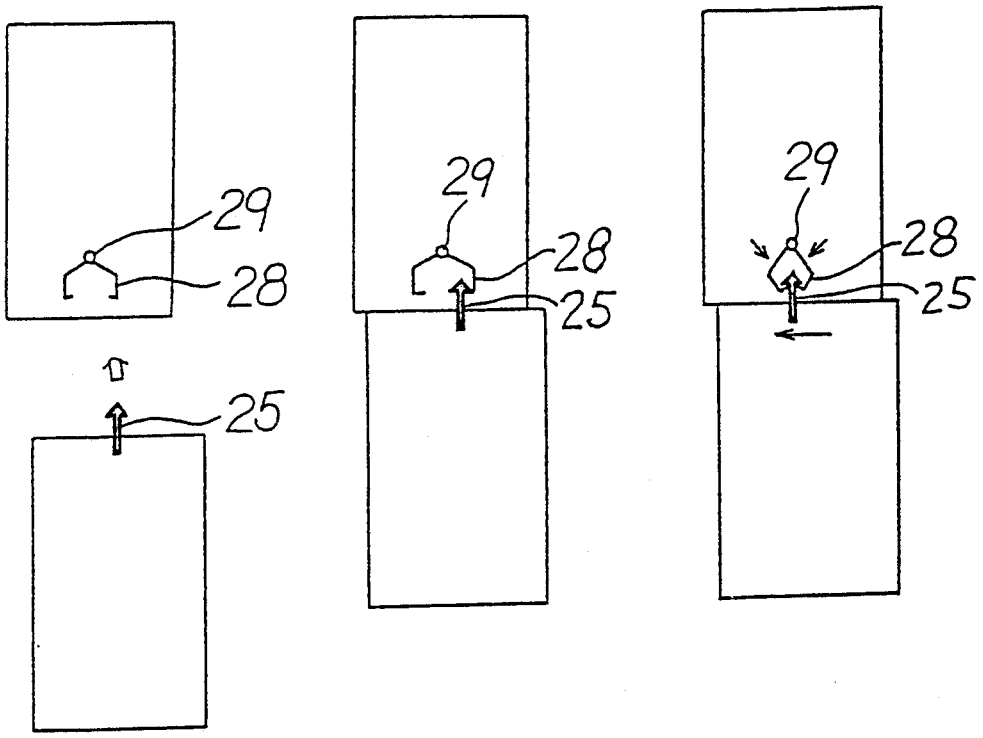
FIGS. 17(A), 17(B) and 17(C) are schematic plan views of two units to be connected, showing the successive steps of the connecting process.
Figure 18A:
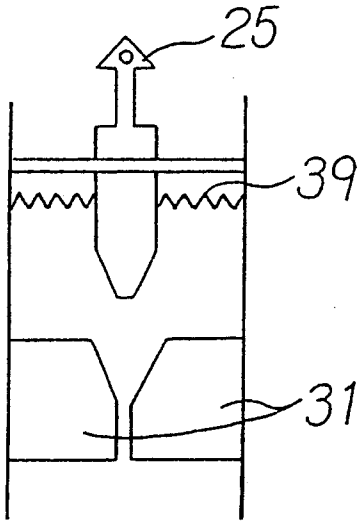
FIGS. 18(A) to 18(D) are schematic plan views of the connecting device showing the successive steps in the manipulation of a male metal member of the connecting device.
Figure 18B:
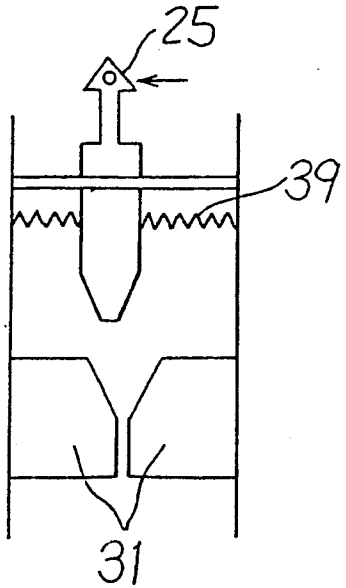
Figure 18C:
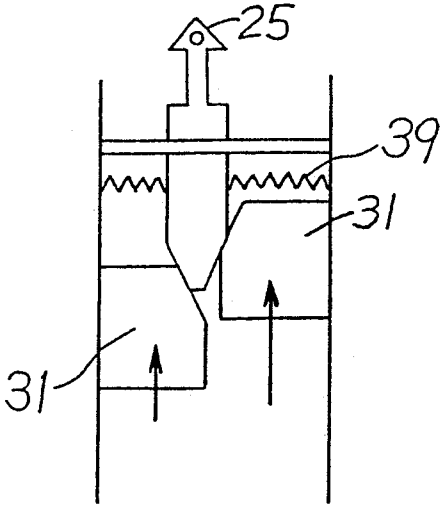

In order to fulfill such requirements, the male metal member 25 at the connecting portion is constructed such (I) that upon connection it can be moved in the lateral direction by a certain magnitude of force; and (II) that after connection it can be fixed with respect to the lateral direction. (See FIGS. 17 and 18). A pair of fixing metal members 31 which are operated by hydraulic cylinders 32 are provided. As shown in FIGS. 18(A) and 18(B), at the time of connection since the pair of fixing metal members 31 are initially held in a retracted state, the male metal member 25 is positioned at a neutral point of a guide section as supported by a spring 39 with respect to the lateral direction. But when the female metal member 28 becomes closed, due to a pinching force of the female metal member 28, the male metal member 25 is forcibly moved to the center line of the female metal member 28 as shown in FIGS. 17(B) and 17(C). Then, as shown in FIG. 18(C), fixing metal members 31 are pushed out by hydraulic cylinders 32 until the fixing metal members 31 strike against the tapered portions of the male metal member 25, thereby blocking the movement of the male metal member in the lateral direction.

Figure 18D:
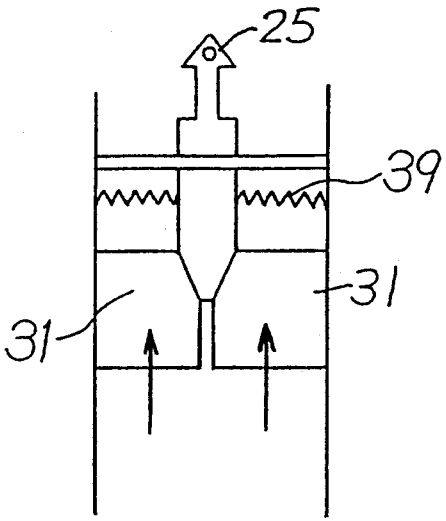

In the case where the center line of the male metal member 25 and the female metal member 28 coincide with each other, the projecting distances of the left and right fixing metal members 31 are even as shown in FIG. 18(D). When the mutual connection between the units is released and the units have been separated from each other, if the fixing members 31 are retracted, the male metal member 25 can be restored to the neutral position by the resilient force of the spring 39 (the state shown in FIG. 18(A)).

Figure 19:
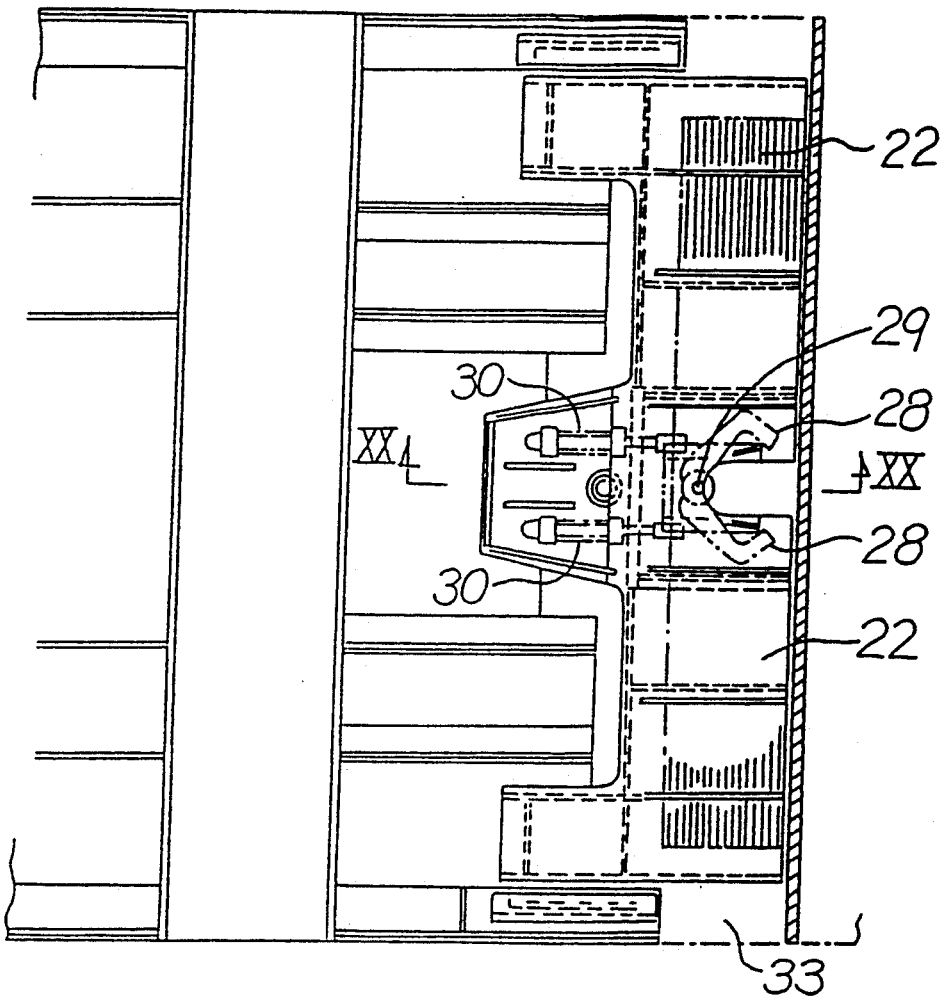
FIG. 19 is a plan view of a floor plate joint portion of the present invention.
Figure 20:
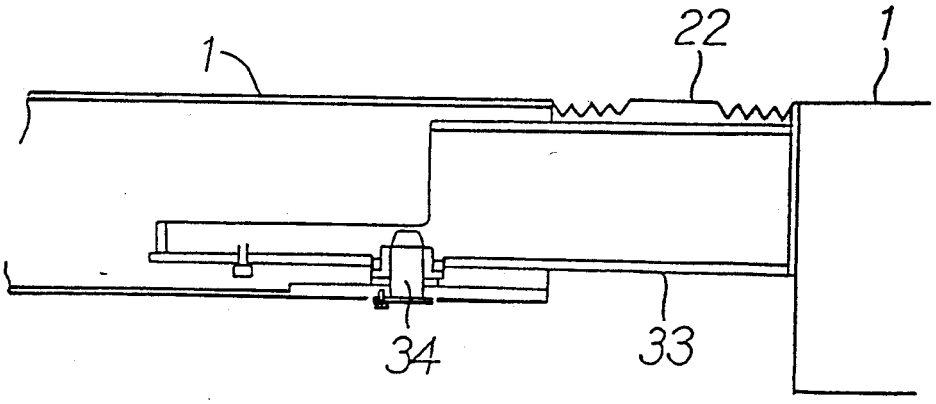
FIG. 20 is a partial cross-sectional view taken along line XX—XX in FIG. 19.

As shown in FIGS. 19 and 20, in the above-mentioned connecting portion, at the joining end of the unit provided with the female metal member 28, a connecting floor piece 33 having th female metal member 28 and hydraulic cylinders 30 for operating the female metal member 28 mounted thereon, is rotatably supported by a center pin 34 disposed vertically at the central portion in the widthwise direction of the same unit.

Figure 21A:
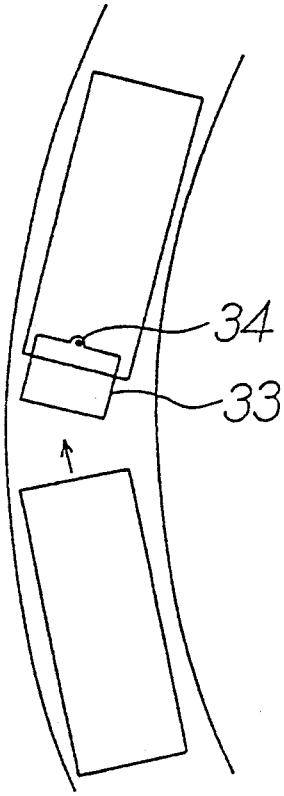
FIGS. 21 and 21(B) are schematic plan views of adjacent constituent units of the present invention showing the connection of the units along a curved line.
Figure 21B:
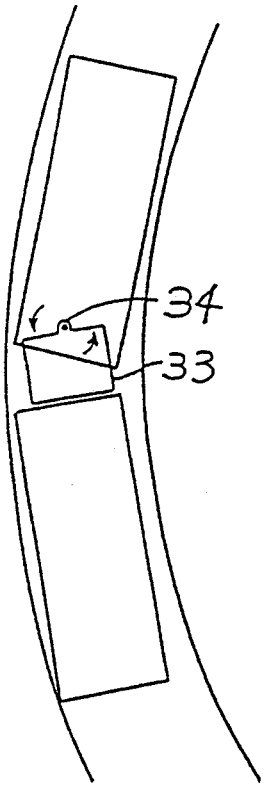

In order for the above-mentioned road constituent units to be installed and connected even on a curved road, it is necessary that the joint portions between the respective adjacent units be adapted to pivot. As shown in FIG. 21(A), in the joining portion between the adjacent road constituent units disposed on a curved road surface, the connecting floor piece 33 is supported by the pin 34 as shown in FIG. 21(B) whereby at the time of joining the connecting floor piece 33 pivots about the pin 34 so that the joining surfaces of the adjacent units come into surface contact with each other.

As shown in FIGS. 19 and 20, on the top surface of the connecting floor piece 33 is disposed an extensible/-retractible resilient member 22 having a continuous corrugated cross section. One end of the resilient member 22 is fixedly secured to the end surface of the floor plate 1 of the unit to which the connecting floor piece 33 is mounted, and the other end thereof is fixedly secured to the top surface of the connecting floor piece 33.

At the time of connection, the connecting floor piece 33 is rotated about the pin 34, and after the resilient member has been pinched between and secured to the opposed end surfaces of the respective floor plates 1 of the respective units, the units are connected by means of the above-described connecting device. Therefore, the road surface level difference between the adjacent floor plates 1 and the connecting floor piece 33 can be eliminated by the resilient member 22.

Figures 22, 23, 24, 25, 26, 27, 28, 29:
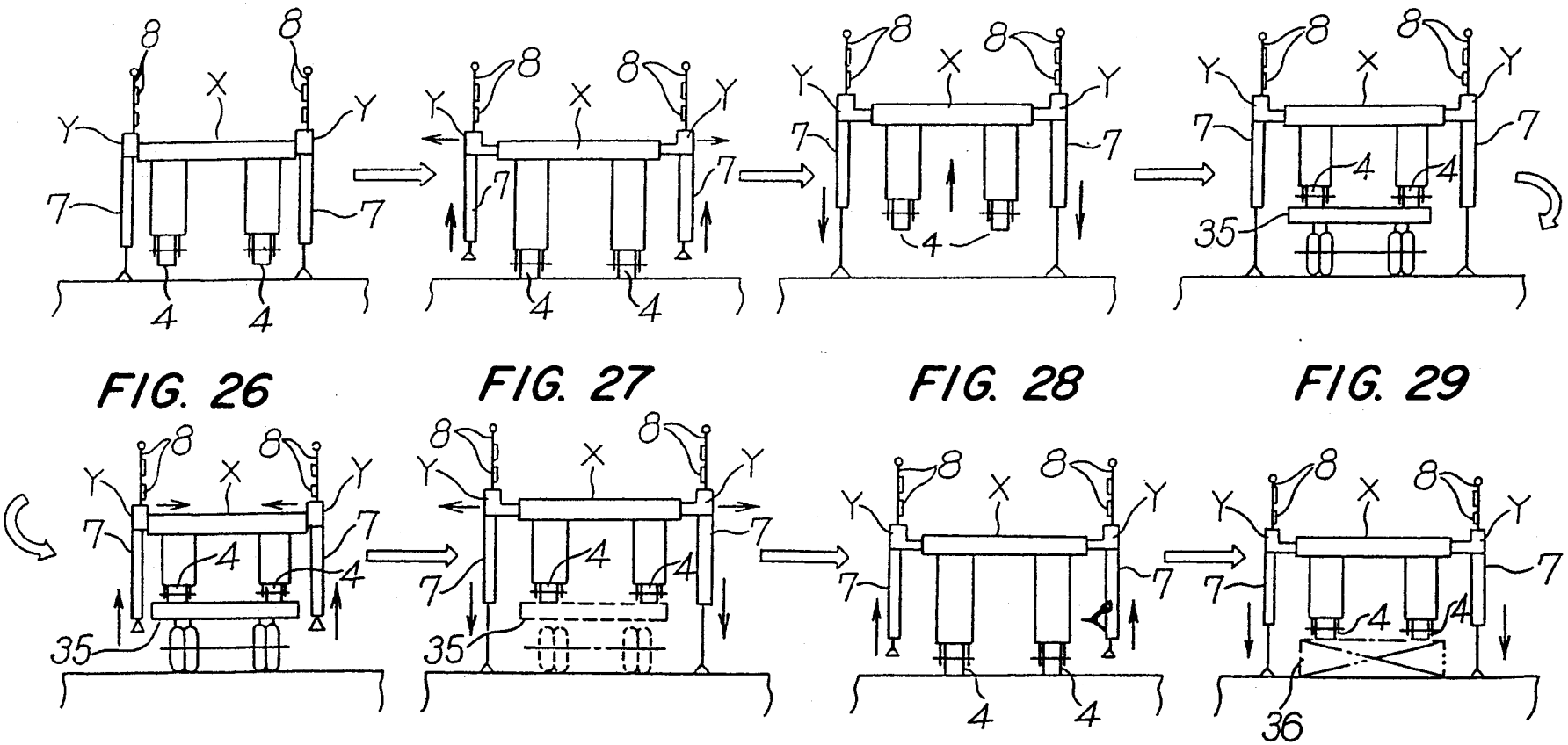
FIGS. 22 to 29 are schematic side views of a constituent unit showing the successive steps during the loading, traveling and installation of the respective road constituent units.

Now, the process of loading the respective road constituent units S and a–f on a trailer or the like will be explained with reference to FIGS. 22 to 29, which respectively illustrate the successive steps of the process. At the time of storage, the side structures Y have their weight supported by the extensible/retractible support legs 7 under a narrowed width condition (FIG. 22).

Next, the extensible/retractible support legs 7 are shortened and pulled up, and the weight of the unit is supported by the traveling devices 4, and the unit travels by itself up to the loading position. At the loading position, the width between the side structure Y is increased (FIG. 23); then, the extensible/retractible legs 7 are extended, and the unit is raised thereby (FIG. 24). Under this condition, a trailer 35 is inserted under the unit (FIG. 25), and the extensible/retractible legs 7 are retracted and pulled up. Now the weight of the unit is supported by the traveling devices 4. Then the width between the side structures Y is reduced (FIG. 26). After the unit has been loaded on the trailer 35, it is fixed to the trailer 35 and is transported to the working location. After having arrived at the working location, operations reverse to the above-mentioned operations are carried out (FIG. 27). Then the unit is unloaded onto a road. After the unit has traveled by itself to the location where it is to be installed and has its width expanded (FIG. 28), the extensible/retractible legs 7 are extended to support the unit and thus the road constituent unit is installed at the road repair location 36 (FIG. 29).

Upon movement of the unit adjacent to a road repair location, the extensible/retractible support legs 7 supporting the respective units S and a–f at the time of installation of the three-dimensional road are all retracted, and the respective road constituent units travel via the traveling devices 4 and the movable traveling devices 5 mounted to the respective units.

Figure 30:
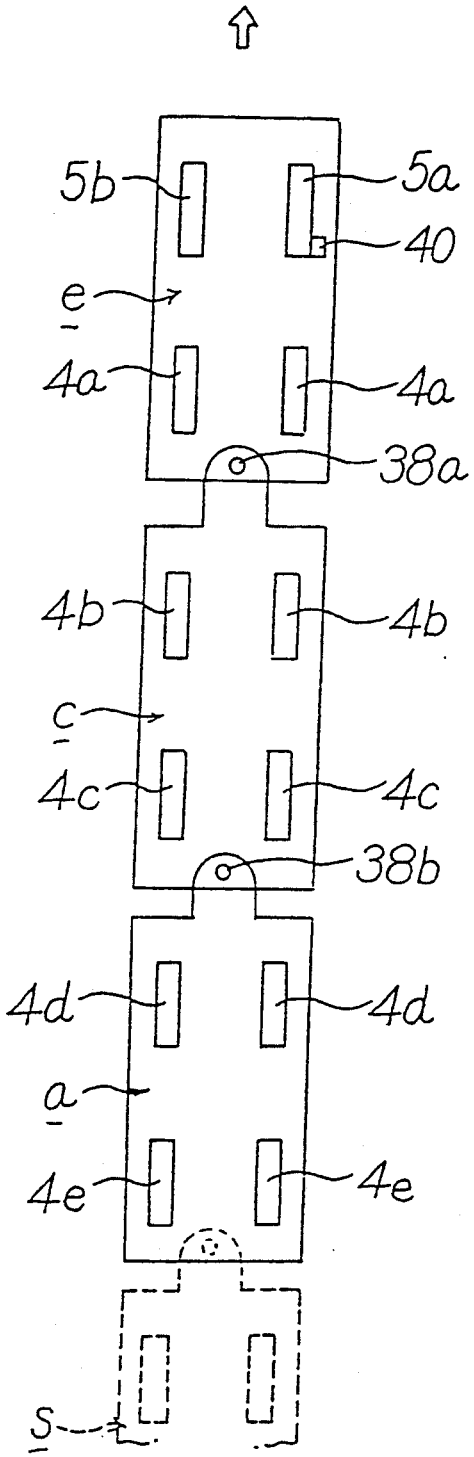
FIG. 30 is a schematic plan view of the constituent units illustrating a method by which the traveling of the units can be controlled.
Figure 31:
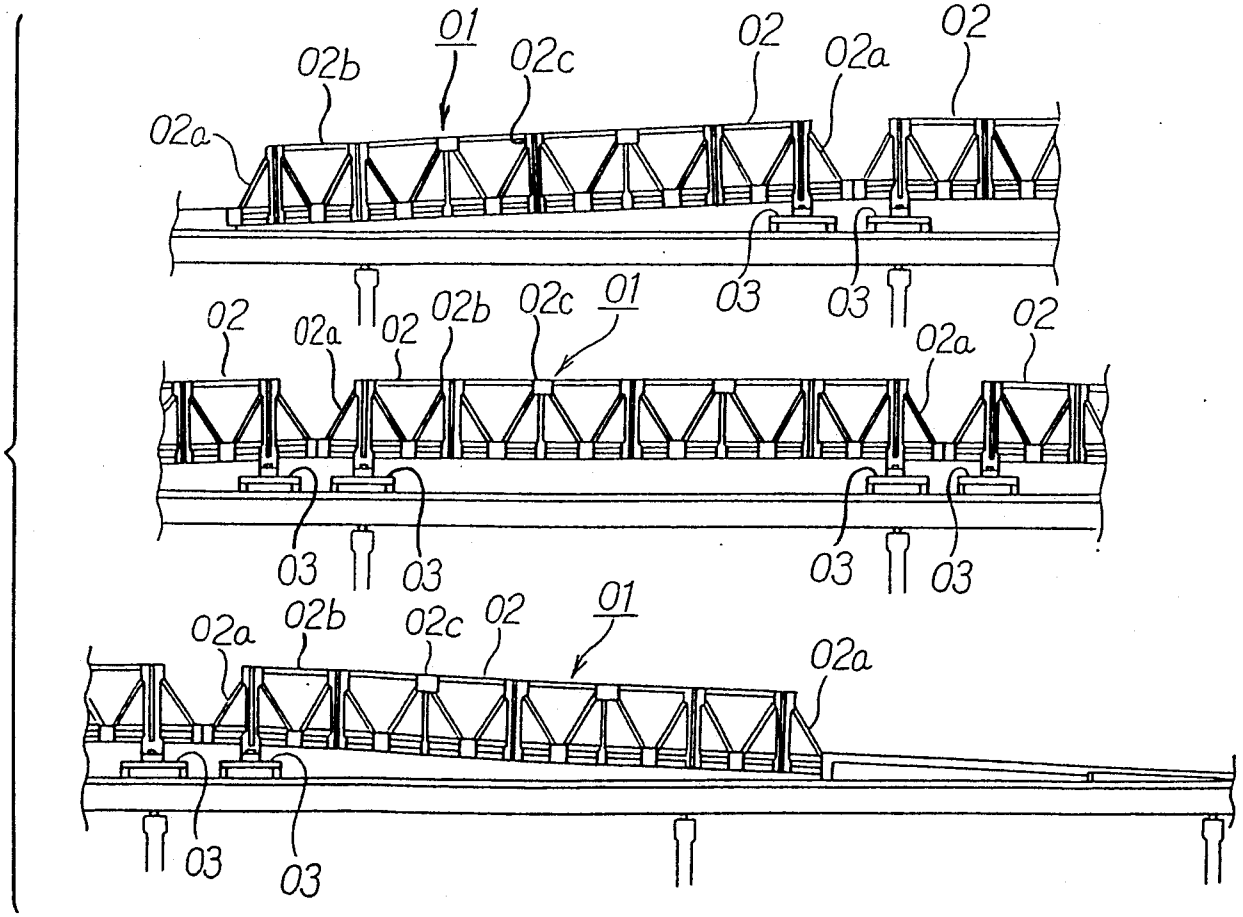
FIG. 31 (PRIOR ART)
FIG. 31 is a side view of a moving type three-dimensional road in the prior art.

The above-mentioned traveling is trackless and can be achieved by a single operator with the respective units connected. FIG. 30 illustrates the traveling of the road with the access road constituent unit e being at the foremost end. Reference numeral 40 designates a traveling speed sensor, and numerals 38*a* and 38*b* designate connecting angle sensors. At first, an operator sets a steering angle $\theta$ by controlling only the wheel of the movable type traveling device 5*a*, and thereby controls the advancement of the unit in a predetermined direction. In response thereto, the wheel of the movable type traveling device 5*b* is automatically controlled so as to have the same steering angle as the wheel of the movable type traveling device 5*a*.

On the basis of the traveling speed information issued by the traveling speed sensor 40, the information of the wheel base between the wheel of the movable type traveling device 5*a* and the rear wheel 4*a* and the information of the steering angle, the rear wheel 4*a* of the foremost unit e is copy-controlled with respect to the front wheel with a time delay so that when the rear wheel 4*a* has come to the position where the wheel of the movable type traveling device 5*a* was a steered by the angle $\theta$, the steering angle of the rear wheel 4*a* also may become $\theta$.

With regard to the front wheel 4*b* of the next succeeding unit c, on the basis of the connecting angle information between the units e and c issued by the connecting angle sensor 38*a*, the wheel base information between the wheels 4*a* and 4*b*, the traveling speed information issued by the traveling speed sensor 40 and the steering angle information of the rear wheel 4*a*, copy-control is effected with a time delay so that when the front wheel 4*b* has come to the position where the rear wheel 4*a* was steered by the angle $\theta$, the steering angle of the front wheel 4*b* also may become $\theta$. Likewise, the wheel 4*c* copies the wheel 4*b*, the wheel 4*d* copies the wheel 4*c*, the wheel 4*e* copies the wheel 4*d*, and in this way the steering angles of all the wheels can be controlled. Thus, an all-wheel-driven multi-connection vehicle traveling along a trackless running passageway under the control of a single operator is realized whereby smooth traveling is achieved.

Steering during traveling is carried out by a 4-wheel steering system (4WS) not shown which is provided at the respective traveling device 4.

As will be apparent from the detailed description above, according to the present invention, owing to the novel structural features of the invention the working road constituent unit and the plurality of access road constituent units can be easily transported as separated from one another. Also, after they have traveled under a connected condition to a desired location such as a bridge, a road or the like by means of traveling devices, if the respective extensible/retractible support legs are extended, an arched three-dimensional road can be easily constructed temporarily. Hence, a working space is formed under the three-dimensional road without especially lowering traffic capacity. Thus, work such as road surface repair and the like can be achieved smoothly, and a performance of a temporary structure and the maneuverability of the three-dimensional road are greatly improved.

While a principle of the present invention has been described above in connection with one preferred embodiment of the invention, it is a matter of course that many apparently widely different embodiments of the present invention could be made without departing from the spirit of the present invention.

What is claimed is:

1. A movable three-dimensional road for forming an arched road surface at a selected road site location, said three-dimensional road comprising:

a working road unit having a central structure including a horizontally extending floor plate, side structures respectively disposed on opposite sides of said central structure and slidingly engaged therewith in a manner in which the side structures are movable transversely of the floor plate of said central structure, each of said side structures including an extensible and retractible support leg which supports said floor plate horizontally above ground level to form a working space under said floor plate, and width adjusting cylinder means connected between said central structure and said side structures for moving said side structures in sliding engagement with said central structure transversely of said horizontally extending floor plate to adjust the effective width of said floor plate;

traveling means associated with said working road unit for allowing said working road unit to be moved therealong to a selected road site location;

access road constituent units each having a central structure including an inclined floor plate longitudinally aligned with the central floor plate of said working road unit, side structures respectively disposed on opposite sides of the central structure of the respective access road constituent unit and slidingly engaged therewith in a manner in which the side structures of the respective access road constituent unit are movable transversely of the inclined floor plate of the central structure thereof, each of the side structures including an extensible and retractible support leg which supports said inclined floor plate, and width adjusting cylinder means connected between the central structure of the respective access road constituent unit and said side structures thereof for moving said side structures thereof in sliding engagement with the central structure thereof transversely of said inclined floor plate to adjust the effective width of the inclined floor plate, the inclined floor plates of said access road constituent units and the horizontally extending floor plate of said working road unit lying in a general arch to comprise a road surface over which vehicles can travel;

a plurality of traveling means respectively associated with each of said access road constituent units for allowing said access road constituent units to be moved therealong to the selected road site location; and connecting means for respectively detachably connecting said access road constituent units to said working road unit through the central structure of said working road unit.

2. A movable three-dimensional road as claimed in claim 1, wherein said connecting means includes a metal male member mounted to one of adjacent said units at an end thereof, cylinder means connected to said male member for projecting and retracting said male member from the end of said one of adjacent said units, and a metal female member mounted to the other of said adjacent said units at an end thereof and adapted to pinch and engage said male member.

3. A movable three-dimensional road as claimed in claim 2, and further comprising a pivot pin extending vertically at the end of said one of adjacent said units and to which pivot pin said connecting means is rotatably mounted, said adjacent units being pivotable relative to one another via rotation of said connecting means about said pivot pin.

4. A movable three-dimensional road as claimed in claim 2, wherein each of said traveling means includes a steerable wheel.

* * * * *